US010794385B2

(12) United States Patent
Shimizu

(10) Patent No.: US 10,794,385 B2
(45) Date of Patent: Oct. 6, 2020

(54) VACUUM PUMP WITH CONTROL DEVICE IN RELATION TO OUTER CYLINDER

(71) Applicant: SHIMADZU CORPORATION, Kyoto (JP)

(72) Inventor: Koichi Shimizu, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 76 days.

(21) Appl. No.: 16/230,367

(22) Filed: Dec. 21, 2018

(65) Prior Publication Data

US 2019/0242386 A1 Aug. 8, 2019

(30) Foreign Application Priority Data

Feb. 2, 2018 (JP) ..... 2018-017243

(51) Int. Cl.

| | |
|---|---|
| ***F04D 19/04*** | (2006.01) |
| ***F04D 25/06*** | (2006.01) |
| ***F04D 29/58*** | (2006.01) |
| ***F04D 29/049*** | (2006.01) |

(52) U.S. Cl.

CPC ..... *F04D 19/04* (2013.01); *F04D 19/042* (2013.01); *F04D 19/044* (2013.01); *F04D 19/046* (2013.01); *F04D 25/068* (2013.01); *F04D 25/0693* (2013.01); *F04D 29/5813* (2013.01); *F04D 29/5853* (2013.01); *F04D 29/049* (2013.01); *F05B 2260/221* (2013.01); *F05B 2260/231* (2013.01)

(58) Field of Classification Search

CPC ..... F04D 19/04–048; F04D 17/168; F04D 29/5853; F04D 29/5813; F04D 25/0693; F04D 25/068; F05B 2260/221; F05B 2260/231

See application file for complete search history.

(56) References Cited

U.S. PATENT DOCUMENTS

| | | | | |
|---|---|---|---|---|
| 5,577,883 | A * | 11/1996 | Schutz | F04D 19/04 415/90 |
| 5,940,576 | A * | 8/1999 | de Simon | F04D 27/00 318/400.27 |
| 5,971,725 | A * | 10/1999 | de Simon | F04D 19/04 417/423.1 |
| 6,442,027 | B2 * | 8/2002 | Sanada | H05K 7/20854 361/704 |
| 9,267,392 | B2 * | 2/2016 | Schroder | F04D 25/068 |
| 9,353,755 | B2 * | 5/2016 | Nagano | F04D 19/042 |

(Continued)

FOREIGN PATENT DOCUMENTS

| | | | | |
|---|---|---|---|---|
| GB | 2553321 | A * | 3/2018 | F04D 29/5853 |
| JP | 2004183619 | A * | 7/2004 | F04D 25/0693 |

(Continued)

*Primary Examiner* — Michael Lebentritt
*Assistant Examiner* — Topaz L. Elliott
(74) *Attorney, Agent, or Firm* — Renner, Otto, Boisselle & Sklar, LLP

(57) ABSTRACT

A vacuum pump comprises: a rotor provided with multiple stages of rotor blades; a base including a ball bearing configured to rotatably support the rotor; an outer cylinder covering the rotor and connected to the base; and a control device including an electronic circuit having a heat generation element. The control device is provided in contact with the outer cylinder.

7 Claims, 4 Drawing Sheets

(56) References Cited

U.S. PATENT DOCUMENTS

| | | | | |
|---|---|---|---|---|
| 9,534,506 | B2 * | 1/2017 | Okudera | F04D 25/0693 |
| 9,890,796 | B2 * | 2/2018 | Moriyama | F04D 29/584 |
| 10,215,191 | B2 * | 2/2019 | Omori | F04D 25/068 |
| 2013/0209272 | A1 * | 8/2013 | Omori | F04D 29/5813 417/26 |
| 2015/0184665 | A1 * | 7/2015 | Yamato | F04D 29/58 415/47 |
| 2016/0195098 | A1 * | 7/2016 | Omori | H02K 11/33 417/423.7 |
| 2017/0227018 | A1 * | 8/2017 | Moriyama | F04D 29/584 |
| 2019/0277296 | A1 * | 9/2019 | Okada | F04D 19/04 |
| 2019/0309760 | A1 * | 10/2019 | Omori | F04D 19/04 |

FOREIGN PATENT DOCUMENTS

| | | | | | |
|---|---|---|---|---|---|
| JP | 2006090251 | A | * | 4/2006 | F04D 29/5813 |
| JP | 2006342686 | A | * | 12/2006 | F04D 25/068 |
| JP | 2014-105695 | A | | 6/2014 | |
| WO | WO-2007013274 | A1 | * | 2/2007 | F04D 19/042 |
| WO | WO-2019159854 | A1 | * | 8/2019 | F04D 39/00 |
| WO | WO-2019159855 | A1 | * | 8/2019 | F04D 37/16 |

* cited by examiner

VACUUM PUMP WITH CONTROL DEVICE IN RELATION TO OUTER CYLINDER

BACKGROUND OF THE INVENTION

1. Technical Field

The present invention relates to an integrated vacuum pump configured such that a pump device and a control device are integrated.

2. Background Art

A turbo-molecular pump has been used as a vacuum pump used for a semiconductor manufacturing device, an analysis device and the like. The turbo-molecular pump includes a pump device and a control device having a drive circuit, a control circuit and the like for driving and controlling a motor or the like in the pump device.

In the turbo-molecular pump, a rotor provided with multiple stages of rotor blades is rotated at high speed to perform pumping, and therefore, bearings configured to rotatably support a shaft as a rotation axis of the rotor in the vicinity of both ends of the shaft are provided. A grease lubricated ball bearing or a magnetic bearing utilizing attractive/repulsive force of a permanent magnet or an electromagnet is used as the bearing. The magnetic bearing has an advantage that the magnetic bearing is contactless, but is larger and costly as compared to the ball bearing. Thus, typically in a small pump, the magnetic bearing is used at one suction port side (high vacuum side) end portion of the shaft, and the small low-cost grease lubricated ball bearing is used at the other exhaust port side (low vacuum side) end portion.

For downsizing the turbo-molecular pump, integration of a pump device and a control device as described in Patent Literature 1 (JP-A-2014-105695) has been known. The turbo-molecular pump described in Patent Literature 1 is downsized in such a manner that a recessed portion is formed at a side surface of a base of the pump device configured to perform vacuum pumping and the control device including aboard on which electronic components are mounted is housed in the recessed portion.

For the turbo-molecular pump, driving with high power is necessary for rotating the rotor at high speed. Thus, the drive circuit in the control device is specifically a great heat generation source. In a case where the pump device and the control device are integrated for downsizing, heat generated at a heat generation element such as the drive circuit in the control device is transmitted to the pump device. When such heat is transmitted to the ball bearing supporting the rotor, a lubricant of the ball bearing, such as grease, is heated and evaporated, leading to a problem that the life of the ball bearing is shortened.

SUMMARY OF THE INVENTION

A vacuum pump comprises: a rotor provided with multiple stages of rotor blades; a base including a ball bearing configured to rotatably support the rotor; an outer cylinder covering the rotor and connected to the base; and a control device including an electronic circuit having a heat generation element. The control device is provided in contact with the outer cylinder.

The control device is provided in contact with the outer cylinder via a high thermal conductive member.

A heat insulating member is provided between the control device and the base.

The heat insulating member is a compressible member.

An air gap is provided between the control device and the base.

The outer cylinder and the base are connected to each other via a low thermal conductive portion.

The heat generation element is arranged in contact with an outer plate not contacting the outer cylinder among outer plates of the control device.

According to the present invention, heat generated from a heat generation element in a control device is released to the outside from the control device. Part of such heat is transmitted to an outer cylinder of a vacuum pump main body, and then, is released to the outside from the outer cylinder. Thus, an increase in the temperature of a ball bearing provided in a base can be prevented.

DETAILED DESCRIPTION OF THE EXEMPLARY EMBODIMENTS

First Embodiment

Figure 1:
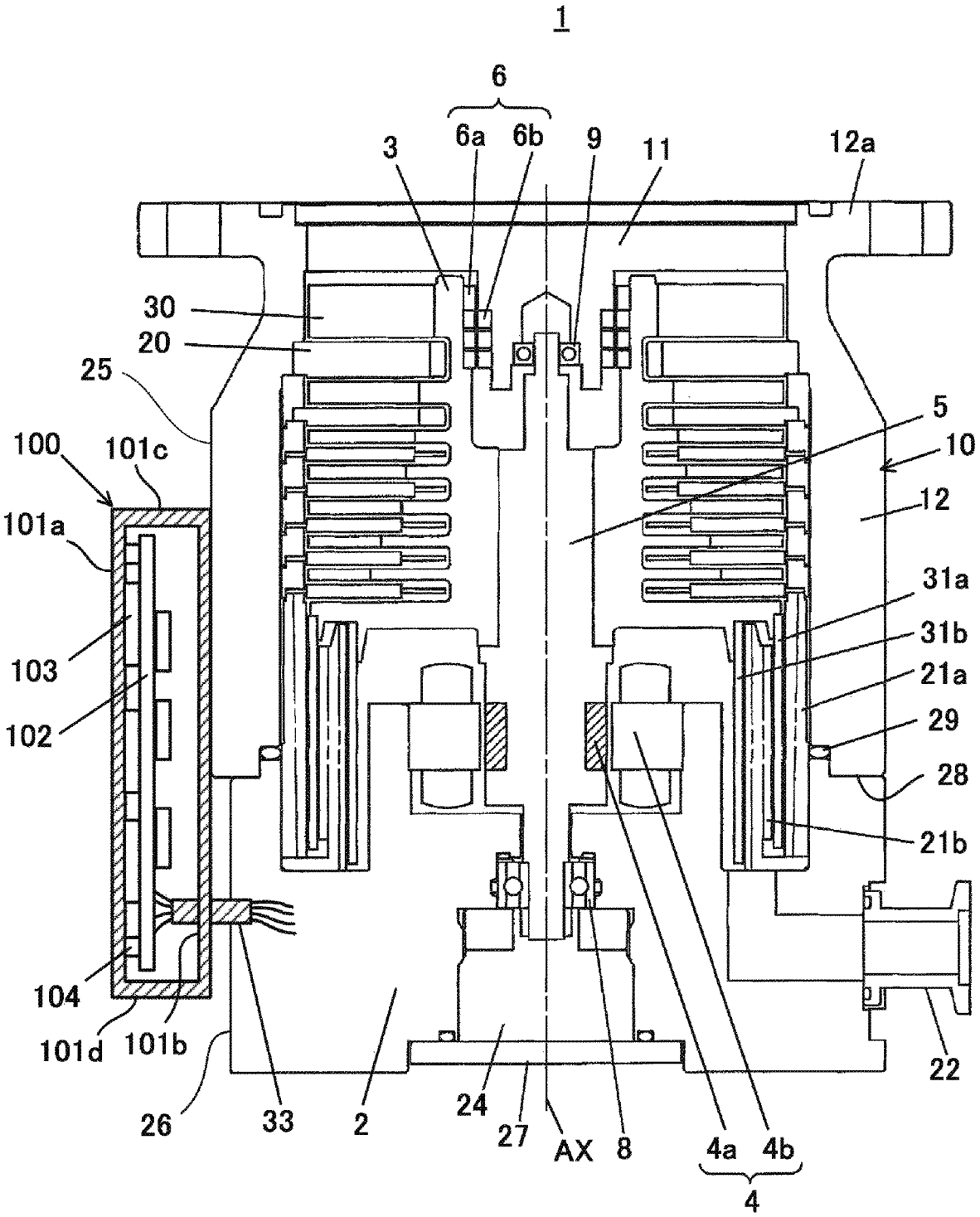
FIG. 1 is a sectional view of a turbo-molecular pump 1 of a first embodiment.

Hereinafter, a first embodiment of the present invention will be described with reference to the drawing. FIG. 1 is a sectional view of a first embodiment of a turbo-molecular pump of the present invention.

A turbo-molecular pump 1 has a pump device 10 configured to perform vacuum pumping, and a control device 100 configured to drive the pump device 10.

A structure of the pump device 10 will be described.

The pump device 10 includes, as exhaust functions, a turbo pump portion including turbine blades, and a Holweck pump portion including a spiral groove.

The turbo pump portion includes multiple stages of rotor blades 30 formed at a rotor 3 rotatable about a rotation axis AX, and multiple stages of stationary blades 20 arranged on a side close to an outer cylinder 12 formed to cover the rotor 3.

On the other hand, the Holweck pump portion provided on a downstream side of the turbo pump portion includes a pair of cylindrical portions 31*a*, 31*b* provided at the rotor 3, and a pair of stators 21*a*, 21*b* arranged on a side close to a base 2. Of inner and outer peripheral surfaces of the cylindrical stators 21*a*, 21*b*, peripheral surfaces facing the cylindrical portions 31*a*, 31*b* are provided with the spiral groove. Note that the spiral groove may be provided on a rotor side instead of providing the spiral groove on a stator side.

A lower end portion 28 of the outer cylinder 12 is connected to an upper end surface of the base 2 via a seal member 29 such as an O-ring, and the outer cylinder 12 is fixed to the base 2 with a not-shown bolt.

The rotor 3 is fastened to a shaft 5, and the rotor 3 and the shaft 5 form an integrated rotary body. The shaft 5 is rotatably driven about the rotation axis AX by a motor 4. Note that the pair of cylindrical portions 31*a*, 31*b* provided at the rotor 3 also rotates together with the rotor 3. A motor rotor 4*a* is provided at the shaft 5, and a motor stator 4*b* is fixed to the base 2.

A lower end side of the shaft 5 is held by a ball bearing 8 which is provided at the base 2 and in which grease is sealed. On the other hand, an upper end side of the shaft 5 is non-contact supported by a permanent magnet magnetic bearing 6 using permanent magnets 6*a*, 6*b*. By these upper and lower bearings, the shaft 5 and the rotor 3 are rotatably supported about a rotor rotation axis.

A vacuum pump of the present embodiment has a touch-down bearing, such as a ball bearing 9, configured to limit runout of a shaft upper portion in a radial direction. The ball bearing 9 is housed in a magnet holder 11. That is, in a steady rotation state of the rotor 3, the shaft 5 and the ball bearing 9 do not contact each other. Note that in a case where great disturbance is applied or in a case where whirling of the rotor 3 becomes greater upon acceleration or deceleration of rotation, the shaft 5 contacts an inner ring of the ball bearing 9. For example, deep groove ball bearings are used as the ball bearings 8, 9.

A base cover 27 configured to seal an opening 24 for attachment/detachment of the ball bearing 8 is bolted to a bottom surface of the base 2. A suction port flange 12*a* for fixing the pump device 10 to a chamber or the like. is formed at the outer cylinder 12. Moreover, an exhaust port 22 is provided at a side surface of the base 2. Gas molecules having flowed in through the suction port flange 12*a* are transferred to a pump downstream side by the turbo pump portion and the Holweck pump portion, and then, are discharged through the exhaust port 22.

Next, the control device 100 will be described.

An attachment surface 25 as a flat surface is, as an example, formed at a side surface of the outer cylinder 12 of the pump device 10. The control device 100 directly contacts the attachment surface 25, and is attached to the attachment surface 25 with a bolt.

The control device 100 includes an electronic circuit having a heat generation element 103, such as a power semiconductor, for driving the motor 4 in the pump device 10, a circuit board 102 and the like, and a housing 101 configured to house these components. The outer shape of the housing 101 is a substantially rectangular parallelepiped shape, but is not limited to such a shape. The outer shape of the housing 101 may be an optional shape. Of six outer plates forming the rectangular parallelepiped shape, each of the sections of four outer plates 101*a*, 101*b*, 101*c*, 101*d* is illustrated in FIG. 1 as the sectional view. The housing 101 indicates the entirety of these six outer plates 101*a* to 101*d* and a not-shown member connecting these outer plates.

The control device 100 is attached to the pump device 10 in such a manner that an upper portion of the outer plate 101*b* is, with the bolt, attached to the side surface (the attachment surface 25) of the outer cylinder 12 of the turbo-molecular pump 1.

A portion of a side surface of the base 2 close to the control device 100 is provided with a flat surface 26, part of the base 2 at the flat surface 26 being removed not to contact the control device 100. Moreover, a power feeding terminal such as a hermetic connector is provided at the flat surface 26 of the base 2 facing a lower portion of the outer plate 101*b*, and an electric wire 33 supplies a control signal or power from the electronic circuit provided in the control device 100 to, e.g., the motor 4 provided in the base 2.

Heat generated from the heat generation element 103, such as the power semiconductor element, in the control device 100 is transmitted to the housing 101, and part of the heat is released to the outside from the outer plates 101*a* to 101*d* of the housing 101. Part of the non-released heat is transmitted to the outer cylinder 12 of the pump device 10 from the housing 101. The outer cylinder 12 has a large surface covering the upper portion of the pump device 10, and therefore, the heat transmitted to the outer cylinder 12 is efficiently released to the outside from the outer cylinder 12.

Note that for further improving the efficiency of heat release from the outer cylinder 12, a cooling fin may be provided on an outer peripheral surface of the outer cylinder 12.

In the control device 100, the circuit board 102 is, by, e.g., screwing, fixed to the outer plate 101*a* on the opposite side of the outer plate 101*b* via a support rod 104. Printed wirings are formed on both surfaces of the circuit board 102, and various electronic components are mounted on both surfaces of the circuit board 102. As illustrated in FIG. 1, the heat generation element 103 such as an inverter element configured to output a PWM drive signal to the motor 4, a driver element configured to drive the inverter element, or a backflow prevention diode element may be arranged on the surface of the circuit board 102 on the opposite side of the outer plate 101*b*. Moreover, these heat generation elements may directly contact the metal outer plate 101*a* of the housing 101 on the opposite side of the outer plate 101*b*, or may contact the metal outer plate 101*a* via a high thermal conductive member.

The heat generation element 103 is, with low thermal resistance, connected to the outer plate 101*a* of the housing 101. Thus, the heat generated at the heat generation element 103 can be transmitted to the metal outer plate 101*a* with a high efficiency, and can be released from the outer plate 101*a*. The outer plate to which the heat generation element 103 is connected is not limited to 101*a*, and may be other outer plates than the outer plate 101*b* connected to the outer cylinder 12.

It may be configured such that neither the circuit board 102 nor the heat generation element 103 is connected to the outer plate 101*b* connected to the outer cylinder 12.

In FIG. 1, the control device 100 is arranged on the opposite side of the pump device 10 from the exhaust port 22, but a position relationship between the control device 100 and the exhaust port 22 is not limited to such arrangement. For example, the control device 100 and the exhaust port 22 may be arranged at positions apart from each other by 90 degrees about the rotation axis AX of the rotor 3, or may be arranged at other optional positions as long as the control device 100 and the exhaust port 22 do not mechanically overlap with each other.

Advantageous Effects of First Embodiment

The turbo-molecular pump (the vacuum pump) 1 of the first embodiment of the present invention includes the rotor 3 provided with the multiple stages of the rotor blades, the base 2 provided with the ball bearing 8 configured to rotatably support the rotor 3, the outer cylinder 12 covering the rotor 3 and connected to the base 2, and the control device 100 having the electronic circuit with the heat generation element 103. The control device 100 is provided in contact with the outer cylinder 12.

With this configuration, the heat generated at the heat generation element 103 is released to the outside from the control device 100, and is transmitted to the outer cylinder 12 from the control device 100 and is released to the outside from the outer cylinder 12. Thus, the effect of reducing or preventing transmission of the heat from the heat generation element to the base 2 and reducing or preventing an increase in the temperature of the ball bearing 8 in the base 2 is provided. As a result, lowering of the degree of vacuum of a vacuum device due to heating and evaporation of the grease of the ball bearing can be suppressed or prevented. Further, a grease decrease can be suppressed or prevented, and the life of the ball bearing and therefore the life (the maintenance cycle) of the vacuum pump can be extended.

Moreover, the present invention is not limited to the vacuum pump including the turbo pump portion and the Holweck pump portion as the exhaust functions, and is also applicable to a vacuum pump including only turbine blades, a vacuum pump including only a drag pump such as a Siegbahn pump or a Holweck pump, or a combination thereof.

Second Embodiment

Figure 2:
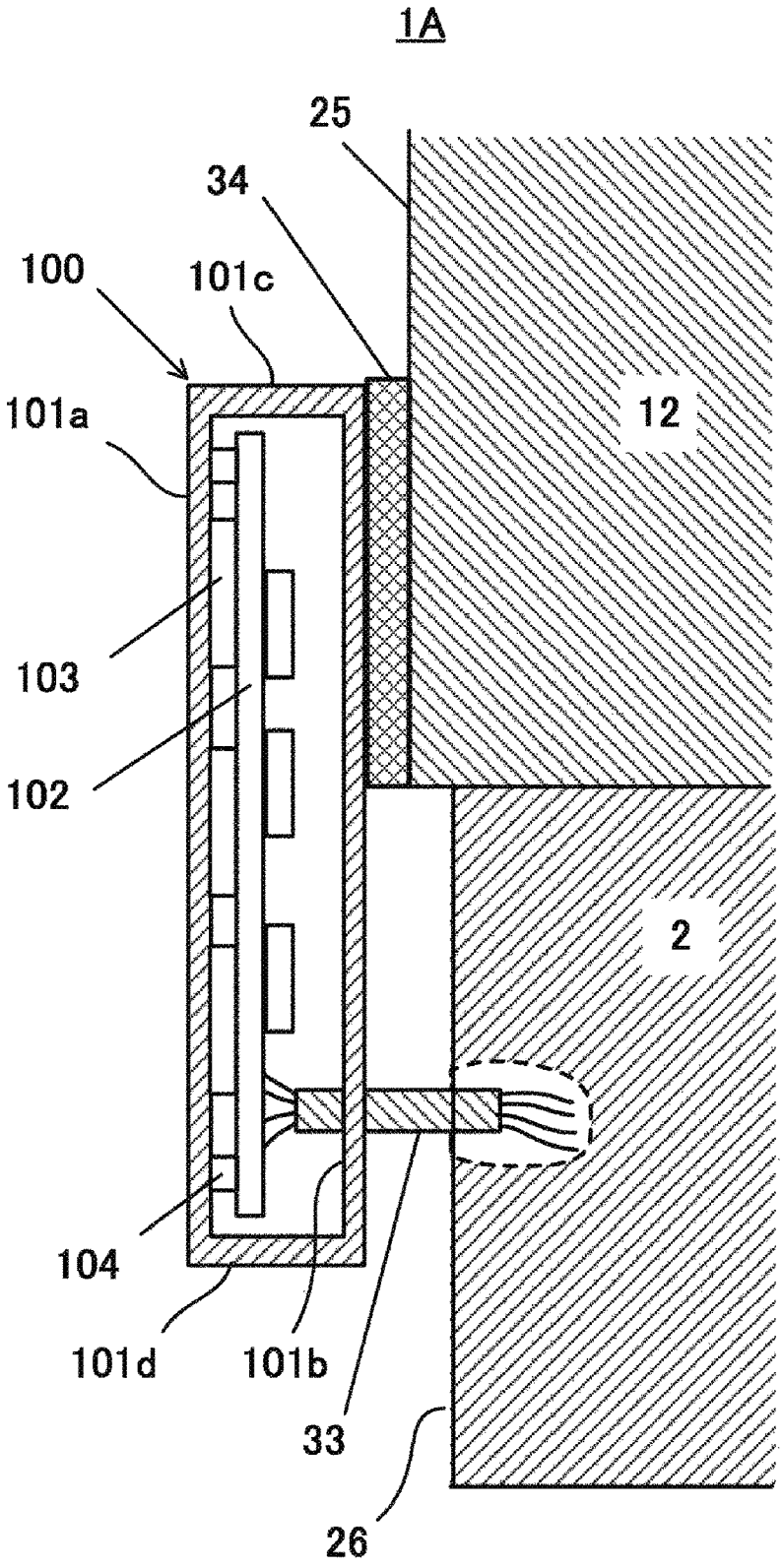
FIG. 2 is a sectional view of part of a turbo-molecular pump 1A of a second embodiment.

A second embodiment of the present invention will be described. FIG. 2 is a view of a control device 100 and an outer cylinder 12 and a base 2 in the vicinity of the control device 100 in a turbo-molecular pump 1A of the second embodiment. The turbo-molecular pump 1A of the second embodiment is similar to the turbo-molecular pump 1 of the first embodiment, except for the form of connection between the control device 100 and the outer cylinder 12. Thus, other portions than those illustrated in FIG. 2 will not be described.

In the turbo-molecular pump 1A of the second embodiment, the control device 100 is attached to an attachment surface 25 of the outer cylinder 12 with a bolt with an upper portion of an outer plate 101*b* of a housing 101 contacting the attachment surface 25 via a high thermal conductive member 34.

The high thermal conductive member 34 is, for example, a thermal conductive seal or a member made of high thermal conductive rubber or silicone. The high thermal conductive member 34 enhances adhesion between the control device 100 and the attachment surface 25 of the outer cylinder 12, and improves the efficiency of heat transmission from the control device 100 to the outer cylinder 12. Considering improvement of the adhesion, a compressible material exhibiting elastic deformability or plastic deformability is preferred as the material of the high thermal conductive member 34.

Heat transmitted to the outer cylinder 12 is, as in the first embodiment, efficiently released to the outside from the outer cylinder 12.

Advantageous Effects of Second Embodiment

The turbo-molecular pump (a vacuum pump) 1A of the second embodiment of the present invention is, in addition to the configuration of the first embodiment, configured such that the control device 100 is provided in contact with the outer cylinder 12 via the high thermal conductive member 34.

With this configuration, heat generated at a heat generation element 103 is more efficiently transmitted from the control device 100 to the outer cylinder 12, and is released to the outside from the outer cylinder 12. Thus, the effect of further reducing or preventing transmission of the heat from the heat generation element to the base 2 as compared to the first embodiment and suppressing or preventing an increase in the temperature of a ball bearing 8 in the base 2 is provided.

Note that in the first embodiment and the second embodiment, the control device 100 and a flat surface 26 of the base 2 do not contact each other for reducing heat transmission from the control device 100 to the base 2, except that an electric wire 33 is provided.

However, for the purpose of, e.g., enhancing mechanical strength in attachment of the control device 100, the control device 100 and the base 2 may at least partially contact each other. In this case, the control device 100 contacts the outer cylinder 12. Thus, heat generated in the control device 100 is transmitted to the outer cylinder 12, and is released to the outside from the outer cylinder 12. Consequently, heat transmission from the heat generation element to the base 2 can be reduced.

Third Embodiment

Figure 3:
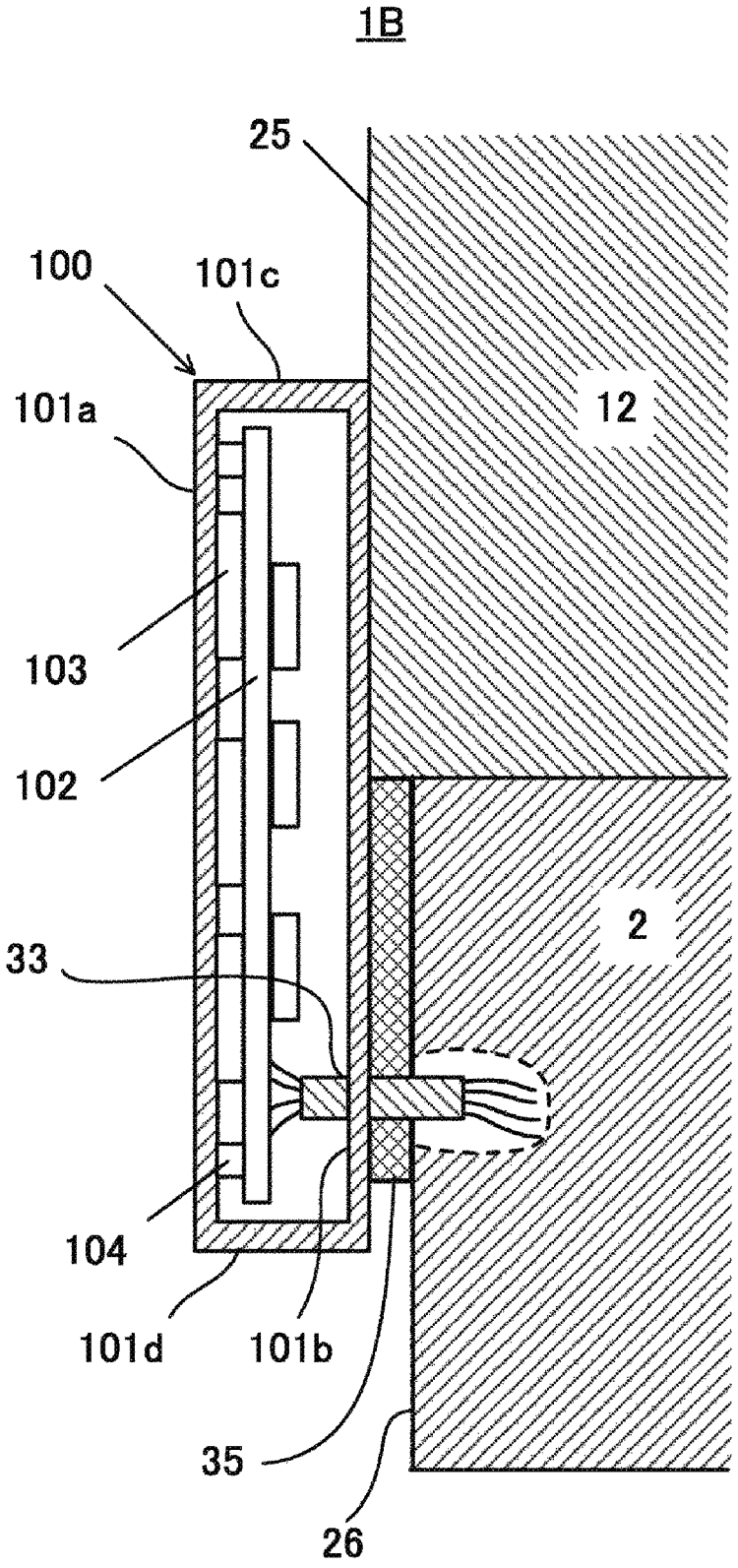
FIG. 3 is a sectional view of part of a turbo-molecular pump 1B of a third embodiment.

A third embodiment of the present invention will be described. FIG. 3 is a view of a control device 100 and an outer cylinder 12 and a base 2 in the vicinity of the control device 100 in a turbo-molecular pump 1B of the third embodiment. The turbo-molecular pump 1B of the third embodiment is similar to the turbo-molecular pump 1 of the first embodiment, except for the form of connection between the control device 100 and the outer cylinder 12. Thus, other portions than those illustrated in FIG. 3 will not be described.

In the turbo-molecular pump 1B of the third embodiment, the control device 100 is, as in the first embodiment, attached to an attachment surface 25 of the outer cylinder 12 with a bolt with an upper portion of an outer plate 101*b* of a housing 101 contacting the attachment surface 25.

On the other hand, a lower portion of the outer plate 101*b* facing a flat surface 26 of the base 2 is provided with a heat insulating member 35, and therefore, heat transmission from the control device 100 to the base 2 is reduced.

Heat insulating (low thermal conductive) rubber or resin may be, as an example, used as the heat insulating member 35. Even in a case where there is a processing error among the outer cylinder 12, the base 2, the outer plate 101*b* and the like, rubber or a soft resin material as a material exhibiting compressibility such as elastic deformability or plastic deformability is preferred as the material of the heat insulating member 35 so that the heat insulating member 35 can be reliably housed in a clearance between the base 2 and the outer plate 101*b*.

Advantageous Effects of Third Embodiment

The turbo-molecular pump (a vacuum pump) 1B of the third embodiment of the present invention is, in addition to the configuration of the first embodiment, configured such that the heat insulating member 35 is provided between the control device 100 and the base 2. With this configuration, the effect of blocking heat transmission from the control device 100 to the base 2 and further reducing or preventing heat transmission from a heat generation element to the base 2 as compared to the first embodiment is provided.

In the case of using a compressible member as the material of the heat insulating member 35, even if there is a processing error among the outer cylinder 12, the base 2, the outer plate 101*b* and the like, the effect of reliably housing the heat insulating member 35 in the clearance between the base 2 and the outer plate 101*b* is provided.

Note that air also exhibits relatively-favorable heat insulating properties, and therefore, a portion where the lower portion of the outer plate 101*b* of the control device 100 and the flat surface 26 of the base 2 face each other may be provided as an air gap as illustrated in FIGS. 1 and 2 so that air can be used as a heat insulating material to insulate the control device 100 and the base 2 from each other.

In this case, the effect of realizing a heat insulating structure with a simple configuration is provided.

(First Variation)

In each of the embodiments above, the heat from the control device 100 including the heat generation element 103 is efficiently transmitted to the outer cylinder 12, and is released to the outside from the outer cylinder 12. Thus, heat transmission from the control device 100 to the base 2 is reduced. In addition, in the present variation, heat transmission from the outer cylinder 12 to the base 2 is also reduced, and therefore, heat transmission from the heat generation element 103 to the base 2 is further reduced.

Figure 4:
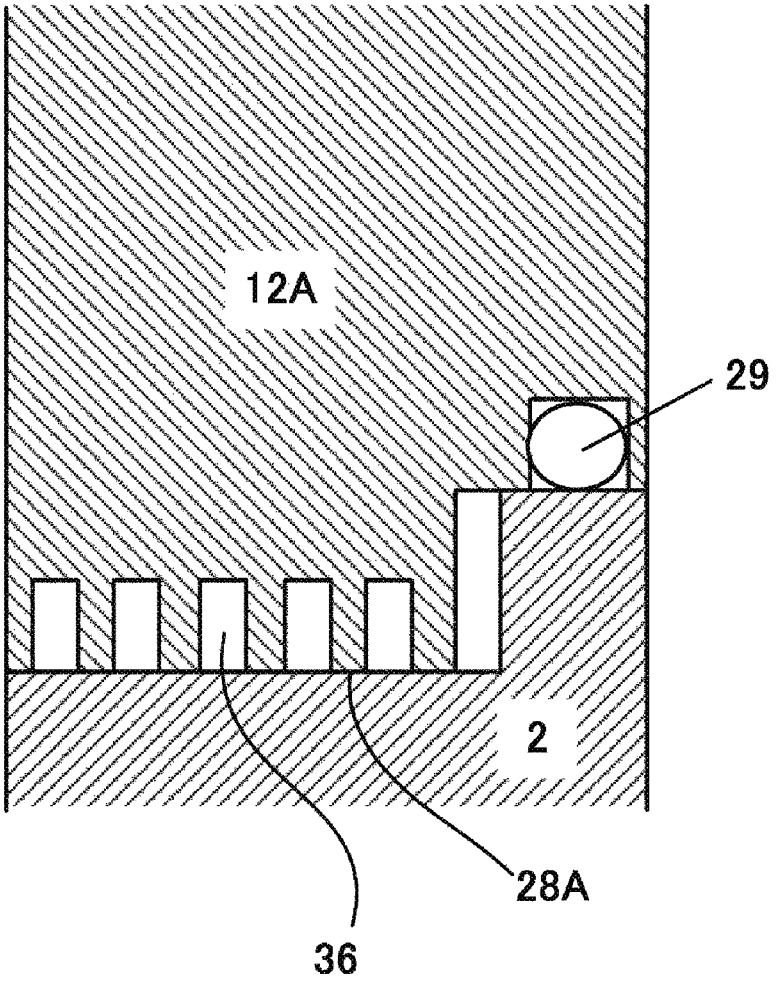
FIG. 4 is a sectional view of part of a turbo-molecular pump of a first variation.

FIG. 4 is an enlarged view of a joint portion between a lower end portion 28A of an outer cylinder 12A and an upper portion of the base 2 in the first variation. Other configurations than those illustrated in FIG. 4 are similar to those of any of the above-described embodiments, and therefore, description thereof will be omitted.

As in each of the above-described embodiments, in the first variation, the lower end portion 28A of the outer cylinder 12A is, inside (a side close to the rotor 3) thereof, connected to the upper end surface of the base 2 via the seal member 29 such as the O-ring. On the other hand, multiple engraved portions 36 are formed outside the lower end portion 28A of the outer cylinder 12A, and a low thermal conductive portion is formed in such a manner that the area of contact with the base 2 is reduced by the engraved portions 36. Thus, heat transmission from the outer cylinder 12 to the base 2 is reduced.

The pattern of the multiple engraved portions 36 in the plane of the lower end portion 28A of the outer cylinder 12A may be a concentric circular pattern about the rotation axis AX of the rotor 3, a radial pattern from the rotation axis AX, or a random pattern. Moreover, the engraved portions 36 may be formed on an upper end surface side of the base 2, or may be provided at both of the lower end portion 28A of the outer cylinder 12A and the upper end surface side of the base 2.

The low thermal conductive portion is not limited to the engraved portions 36, and may be formed in such a manner that a low thermal conductive film is provided on one or both of the lower end portion 28A of the outer cylinder 12A and the upper end surface of the base 2. Alternatively, the low thermal conductive portion may be formed in such a manner that a thin piece made of a material exhibiting relatively-low thermal conductivity, such as stainless steel, is provided between the lower end portion 28A of the outer cylinder 12A and the upper end surface of the base 2.

Advantageous Effects of First Variation

In the present variation, the heat insulating member 35 is provided between the control device 100 and the base 2 in addition to the configuration of each of the above-described embodiments. With this configuration, the effect of blocking heat transmission from the control device 100 to the base 2 via the outer cylinder 12 and further reducing or preventing heat transmission from the heat generation element to the base 2 as compared to each of the above-described embodiments is provided.

In the turbo-molecular pump (the vacuum pump) of any of the embodiments above, a lower end of the control device 100 is preferably on an upper side of a lower end of the base 2 as illustrated in FIGS. 1, 2, and 3. In other words, a portion of the control device 100 facing the pump device 10 is, for reducing heat conduction from the control device 100 to the base 2, preferably arranged to face the outer cylinder 12 as much as possible.

Moreover, in the turbo-molecular pump of any of the embodiments above, a cooling fan or a liquid cooling system for cooling the base 2 and the outer cylinder 12 may be further provided.

Various embodiments and the variations have been described above, but the present invention is not limited to these contents. Moreover, each of the embodiments and the variations may be applied alone or in combination. Other aspects conceivable within the scope of the technical idea of the present invention are also included in the scope of the present invention.

What is claimed is:

1. A vacuum pump comprising:
a rotor provided with multiple stages of rotor blades;
a base including a ball bearing configured to rotatably support the rotor;
an outer cylinder covering the rotor and connected to the base; and
a control device including an electronic circuit having a heat generation element,
wherein the outer cylinder is aligned in abutment with the base in an axial direction of the rotor,
the control device spans the abutment of the outer cylinder and the base in the axial direction, and
the control device is provided in contact with the outer cylinder and is not in contact with the base.

2. The vacuum pump according to claim 1, wherein
an air gap is provided between the control device and the base.

3. The vacuum pump according to claim 1, wherein
the heat generation element is arranged in contact with an outer plate not contacting the outer cylinder among outer plates of the control device.

4. A vacuum pump comprising:
a rotor provided with multiple stages of rotor blades;
a base including a ball bearing configured to rotatably support the rotor;
an outer cylinder covering the rotor and connected to the base; and
a control device including an electronic circuit having a heat generation element,
wherein the control device is provided in contact with the outer cylinder, and
the control device is provided in contact with the outer cylinder via a high thermal conductive member.

5. A vacuum pump comprising:
a rotor provided with multiple stages of rotor blades;
a base including a ball bearing configured to rotatably support the rotor;
an outer cylinder covering the rotor and connected to the base; and
a control device including an electronic circuit having a heat generation element,
wherein the control device is provided in contact with the outer cylinder, and
a heat insulating member is provided between the control device and the base.

6. The vacuum pump according to claim 5, wherein
the heat insulating member is a compressible member.

7. A vacuum pump comprising:
a rotor provided with multiple stages of rotor blades;

a base including a ball bearing configured to rotatably support the rotor;

an outer cylinder covering the rotor and connected to the base; and a control device including an electronic circuit having a heat generation element, wherein the control device is provided in contact with the outer cylinder, and the outer cylinder and the base are connected to each other via a low thermal conductive portion.

* * * * *